US011047026B2

(12) United States Patent
Konyashin et al.

(10) Patent No.: US 11,047,026 B2
(45) Date of Patent: Jun. 29, 2021

(54) CEMENTED CARBIDE MATERIAL

(71) Applicant: ELEMENT SIX GMBH, Burghaun (DE)

(72) Inventors: Igor Yurievich Konyashin, Burghaun (DE); Bernd Heinrich Ries, Burghaun (DE)

(73) Assignee: Element Six GmbH, Burghaun (DE)

( * ) Notice: Subject to any disclaimer, the term of this patent is extended or adjusted under 35 U.S.C. 154(b) by 0 days.

(21) Appl. No.: 16/461,456

(22) PCT Filed: Aug. 16, 2018

(86) PCT No.: PCT/EP2018/072236
§ 371 (c)(1),
(2) Date: May 16, 2019

(87) PCT Pub. No.: WO2019/038180
PCT Pub. Date: Feb. 28, 2019

(65) Prior Publication Data

US 2019/0345589 A1 Nov. 14, 2019

(30) Foreign Application Priority Data

Aug. 23, 2017 (GB) ..... 1713532

(51) Int. Cl.
*C22C 29/08* (2006.01)
*B22F 3/16* (2006.01)
(Continued)

(52) U.S. Cl.
CPC ..... *C22C 29/08* (2013.01); *B22F 3/16* (2013.01); *B22F 3/24* (2013.01); *B22F 5/00* (2013.01);
(Continued)

(58) Field of Classification Search
CPC ..... B22F 2005/001; B22F 2302/10; B22F 2302/35; C22C 1/051; C22C 29/00;
(Continued)

(56) References Cited

U.S. PATENT DOCUMENTS 4,911,989 A 3/1990 Minoru et al.
6,126,709 A 10/2000 Akerman et al.
(Continued)

FOREIGN PATENT DOCUMENTS

EP 1100976 A1 5/2001
GB 2489583 A 10/2012
(Continued)

OTHER PUBLICATIONS

European Patent Application No. 18755475.3, Intention to Grant Patent dated Sep. 20, 2019, 7 pages.
(Continued)

*Primary Examiner* — Vanessa T. Luk
(74) *Attorney, Agent, or Firm* — Dean W. Russell; Clark F. Weight; Kilpatrick Townsend & Stockton LLP

(57) ABSTRACT

A cemented carbide body is provided with improved resistance to mechanical fatigue. The cemented carbide body comprises tantalum in the binder matrix material. The tantalum content is between 1.5 weight per cent and 3.5 weight per cent of the binder content. The binder comprises tantalum-containing inclusions having a mean largest linear dimension of no more than 80 nm

19 Claims, 9 Drawing Sheets

(51) Int. Cl.
*C22C 1/05* (2006.01)
*B22F 3/24* (2006.01)
*B22F 5/00* (2006.01)

(52) U.S. Cl.
CPC ..... *C22C 1/051* (2013.01); *B22F 2003/248* (2013.01); *B22F 2005/001* (2013.01); *B22F 2302/10* (2013.01)

(58) Field of Classification Search
CPC ..... C22C 29/005; C22C 29/067; C22C 29/08; C22C 32/0052
See application file for complete search history.

(56) References Cited

U.S. PATENT DOCUMENTS

| | | | | |
|---|---|---|---|---|
| 2006/0093859 | A1* | 5/2006 | Konyashin | C22C 29/08 428/698 |
| 2011/0168454 | A1* | 7/2011 | Keshavan | C23C 16/40 175/428 |
| 2012/0085585 | A1 | 4/2012 | Scott et al. | |
| 2014/0023546 | A1* | 1/2014 | Konyashin | B22F 7/008 419/18 |
| 2015/0360291 | A1 | 12/2015 | Konyashin et al. | |

FOREIGN PATENT DOCUMENTS

| | | | | |
|---|---|---|---|---|
| GB | 2491256 | A | 11/2012 | |
| JP | 2005068513 | A | 3/2005 | |
| WO | 2010036569 | A2 | 4/2010 | |
| WO | 2010097784 | A1 | 9/2010 | |
| WO | WO-2011029773 | A1 * | 3/2011 | C22C 26/00 |
| WO | 2012130851 | A1 | 10/2012 | |

OTHER PUBLICATIONS

European Patent Application No. 18755475.3, Decision to Grant Patent dated Jan. 10, 2020, 2 pages.

Exner et al., "A review of parameters influencing some mechanical properties of tungsten carbide-cobalt alloys," Powder Metallurgy, 1970, pp. 13-31, vol. 13, The Institute of Metals.

Tretyakov, "Bases of materials science and production technology of sintered cemented carbides," Metallurgiya, 1972, pp. 194-195, Moscow.

Konyashin et al., "Wear damage of cemented carbides with different combinations of WC mean grain size and Co content. Part II: Laboratory performance tests on rock cutting and drilling," Int. Journal of Refractory Metals and Hard Materials, 2014, pp. 230-237, vol. 45, Elsevier Ltd.

Konyashin, Igor, "Cemented Carbides for Mining, Construction and Wear Parts," Comprehensive Hard Materials, 2014, pp. 425-451, vol. 1, Elsevier Ltd.

Konyashin, I., et al, "Novel Ultra-Coarse Hardmetal Grades with Reinforced Binder for Mining and Construction," International Journal of Refractory Metals & Hard Materials, 2005, pp. 225-232, vol. 23, Elsevier Ltd.

Konyashin, I., et al, "On the Mechanism of WC Coarsening in WC-Co Hardmetals with Various Carbon Contents," International Journal of Refractory Metals & Hard Materials, 2009, pp. 234-243, vol. 27, Elsevier Ltd.

United Kingdom Patent Application No. GB1713532.8, Combined Search and Examination Report dated Feb. 5, 2018, 8 pages.

International Patent Application No. PCT/EP2018/072236, International Search Report and Written Opinion dated Oct. 23, 2018, 19 pages.

* cited by examiner

CEMENTED CARBIDE MATERIAL

FIELD OF THE INVENTION

This disclosure relates generally to cemented carbide material and tools comprising the same.

BACKGROUND

Cemented carbide material comprises particles of metal carbide such as tungsten carbide (WC) or titanium carbide (TiC) dispersed within a binder material comprising a metal such as cobalt (Co), nickel (Ni) or metal alloy. The binder phase may be said to cement the carbide particles together as a sintered compact. Measurements of magnetic properties may be used to measure indirectly aspects of the microstructure and properties of cemented carbide materials. The magnetic coercive force (or simply coercive force or coercivity) and magnetic moment (or magnetic saturation) can be used for such purposes.

Cemented carbides have a relatively high fracture toughness and hardness, and so are used in tools that exploit these properties. Examples of such tools include picks for road planing or mining applications. However, the hardness and wear-resistance WC-Co cemented carbides usually can be improved only at the expense of fracture toughness and strength (Konyashin, "Cemented Carbides for Mining, Construction and Wear Parts", Comprehensive Hard Materials, Elsevier Science and Technology, 2014). It is therefore difficult to simultaneously improve hardness, wear-resistance, fracture toughness and transverse rupture strength (TRS) of cemented carbide materials.

One possible approach to improve both the hardness and fracture toughness is the fabrication of cemented carbides with a uniform microstructure containing rounded WC grains. U.S. Pat. No. 6,126,709 discloses such a cemented carbide material, in which the microstructure is coarse and very uniform containing large rounded WC grains. A disadvantage of this material is the presence of very thick Co layers around the large, rounded WC grains. The thick Co layers are characterized by low hardness and wear-resistance and therefore tools using this type of material quickly become worn during rock-cutting or rock-drilling operations. This leaves unsupported WC grains, which can be easily cracked, destroyed and detached resulting in high wear rates (Konyashin et. al., "Novel Ultra-Coarse Hardmetal Grades with Reinforced Binder for Mining and Construction", International Journal of Refractory Metals and Hard Materials, 23(2005)225-232).

One approach to mitigate the low wear-resistance of thick Co interlayers in ultra-coarse WC-Co materials mentioned above is suggested in WO2012/130851A1. This discloses a cemented carbide material in which the binder layers are hardened and reinforced by nanoparticles having a composition according to the formula $Co_xW_yC_z$. The cemented carbide material disclosed in WO2012/130851A1 is characterized by a very low carbon content and consequently low magnetic moment, which is known to lead to the suppression or complete elimination of dissolution and re-crystallization of fine-grain WC fraction usually present in initial WC powders during liquid-phase sintering (see Konyashin et. al., "On the Mechanism of WC Coarsening in WC-Co Hardmetals with Various Carbon Contents", International Journal of Refractory Metals and Hard Materials, 27 (2009) 234-243). As a result, the microstructure of the cemented carbides disclosed in WO2012/130851A1 is characterized by relatively low uniformity and comprises much fine-grain WC fraction present in the original ultra-coarse WC powder, which leads to their reduced fracture toughness.

A disadvantage of the cemented carbides disclosed in the documents mentioned above is their low resistance to mechanical fatigue. This means that they cannot be employed in applications in which they will be subjected to severe mechanical fatigue, for example in percussive drilling. The approach of the binder reinforcement by the W-Co—C nanoparticles disclosed in the prior art documents, which includes a process of heat-treatment or ageing, cannot be used for medium-grain WC-Co cemented carbides widely employed, for example, for rotary and percussive drilling.

SUMMARY

It is an object to provide a cemented carbide material with an improved resistance to mechanical fatigue.

WC-Co cemented carbides containing tantalum carbide or inclusions on the basis of tantalum carbides have been known for a long time and are widely employed for various applications inclosing mining and construction (see e.g. (Konyashin, "Cemented Carbides for Mining, Construction and Wear Parts", Comprehensive Hard Materials, Elsevier Science and Technology, 2014). Nevertheless, almost exceptionally the microstructure of such cemented carbides comprises macro-inclusion (inclusions larger than 500 nm) of the so so-called "second carbide phase" on the basis of TaC, which is a mixed (Ta,W)C carbide, the presence of which leads to a decreased transverse rupture strength (TRS and other mechanical properties. The solubility limit of tantalum or TaC in the binder phase of WC-Co cemented carbides is negligibly low (of the order 0.1 wt. % or less, see e.g. V. I. Tretyakov, Bases of materials science and production technology of sintered cemented carbides, Moscow, Metallurgiya 1972.). Above this solubility limit the extra amount of Ta, which cannot dissolve in the Co-based binder, crystallizes in form of macro-inclusions of the second (Ta,W)C carbide phase.

It has now been surprisingly found out that if after liquid-phase sintering a cemented carbide material containing 1.5 wt. % to 3.5 wt. % TaC is subjected to a special cooling procedure, namely it is cooled at very fast cooling rates above certain values, the whole amount of Ta exceeding the solubility limit mentioned above precipitates in the binder phase as carbide or intermetallic nanoparticles. Such tantalum-containing nanoparticles are generally smaller than 80 nm, but can be as small as roughly 5 nm. Also if has been surprisingly found out that if the TaC content is in the range mentioned above and the cooling rates are above the certain values, the macro-inclusion of the second (Ta,W)C carbide phase does not form in the microstructure of the Ta-containing cemented carbides. Both the presence of the hard nanoparticles in the binder phase and the absence of macro-inclusions of the second (Ta,W)C carbide phase in the microstructure lead to a dramatic improvement of performance properties of cemented carbides, especially in applications including the impact of severe mechanical and thermal fatigue, for example in percussive drilling and road-planing.

According to a first aspect of the invention, there is provided a cemented carbide body comprising: tungsten carbide grains; a binder matrix material comprising or consisting of any of cobalt, nickel and iron or a mixture thereof, wherein the tungsten carbide grains are disposed in the binder matrix material; the binder matrix material further comprising or consisting of tantalum-containing inclusions, the tantalum-containing inclusions being carbide nanoparticles or intermetallic nanoparticles, the tantalum-containing inclusions having the shape that is any one of substantially spherical, platelet-like or needle-like, the tantalum content being between 1.5 weight per cent and 3.5 weight per cent of the binder content; and wherein the tantalum-containing inclusions have a mean largest linear dimension of no more than 80 nm.

The tantalum-containing inclusions may have a mean largest linear dimension of no more than 50 nm. The tantalum-containing inclusions may have a mean largest linear dimension of below 20 nm or below 10 nm.

Optionally, the cemented carbide body is substantially free of Ta-containing grains having a largest mean linear dimension greater than 200 nm, and preferably greater than 500 nm.

Optionally, the tungsten carbide grains have a mean grain size of about 2.5 μm. Alternatively, the tungsten carbide grains have a mean grain size of about 5 μm As an option, the cemented carbide body is substantially free of eta-phase and free carbon, and wherein the carbon content is such that a magnetic moment of the cemented carbide body is at least 87 percent of the theoretical value of a cemented carbide body comprising a binder material of nominally pure Co, Ni and/or Fe or a mixture thereof.

As an option, the cemented carbide body according to any preceding claim, wherein the cemented carbide body is substantially free of eta-phase and free carbon, and wherein the carbon content is such that a magnetic moment of the cemented carbide body is at least 70 percent of the theoretical value of a cemented carbide body comprising a binder material of nominally pure Co, Ni and/or Fe or a mixture thereof.

The inclusions may comprise a material according to the formula $Ta_xW_yCo_zC$ phase, where x is a value in the range from 1 to 8, y is a value in the range from 0 to 8 and z is a value in the range from 0 to 10.

The inclusions may comprise any of a cubic η-phase comprising $Co_6(W,Ta)_6C$ and a hexagonal η-phase comprising $Co_3(W,Ta)_{10}C_3$.

The cemented carbide body may further comprise lamellae shaped tantalum-containing nanoparticles with a mean largest linear dimension of no more than 80 nm.

Preferably, the binder nano-hardness is selected from any of at least 6 GPa, at least 8 GPa and at least 10 GPa.

Optionally, the coercive force of the cemented carbide body is greater by at least 10% than a corresponding cemented carbide of the same Co content and tungsten carbide mean grain size containing no tantalum.

The body may comprise a surface region adjacent a surface and a core region remote from the surface, the surface region and core region being contiguous with one another, and wherein a mean binder fraction of the core region is greater than that of the surface region.

Optionally, the surface region is a layer integrally formed with the core region, the surface region having a thickness of at least 0.5 mm and at most 10 mm.

Optionally, the mean binder fraction within the surface region is lower than that within the core region by a factor of at least 0.05 and at most 0.90.

The body may be employed as a substrate for polycrystalline diamond (PCD).

The body may be employed for high-pressure high-temperature components for diamond or cBN synthesis.

According to a second aspect of the invention, there is provided a method of making a cemented carbide body, the method comprising:

a. milling together powders of tungsten carbide, a tantalum containing material, and powders containing any of cobalt, nickel and iron;
b. pressing the milled powder to form a green body;
c. sintering the green body in a vacuum at a temperature between 1400° C. and 1480° C. for a time of at least 15 minutes;
d. cooling the sintered body down from the sintering temperature to a temperature of 1365° C. at a cooling rate of at least 2° C. per minute;
e. further cooling the sintered body from 1365° C. to 1295° C. at a cooling rate of at least 3° C. per minute.

A 'binder mean free path' in the sintered body may be in the range of 0.1 μm to 1 μm after cooling down to room temperature. The 'mean free path' is a widely used term in the literature on carbides. It is perhaps the single most important parameter characterizing the microstructure. It is a measure of the thickness of the binder and depends on both the binder composition and the particle sizes. It is nominally based on the average spacing of particles, all of which are assumed to be separated from each other by binder layers, and may take into account the presence of contiguous carbide particles without any binder phase between them (Exner, H. E, Gurland, J., POWDER METALLURGY, 13(1970) 20-31, "A review of parameters influencing some mechanical properties of tungsten carbide-cobalt alloys")

Optionally, the tantalum containing material is selected from any of tantalum, tantalum carbide, and tantalum containing compounds.

Optionally, the method further comprises sintering the green body in a vacuum at a temperature between 1400° C. and 1480° C. for a duration of no more than 360 minutes.

In a third aspect of the invention, a tool comprises the cemented carbide body in accordance with the first aspect of the invention. Preferably, the tool is a pick for road-planing or a pick for mining. Alternatively, the tool may be a drill bit for rotary or percussive drilling.

According to a fourth aspect of the invention, there is provided a cemented carbide body comprising: tungsten carbide grains; a binder matrix material comprising or consisting of any of cobalt, nickel and iron or a mixture thereof, wherein the tungsten carbide grains are disposed in the binder matrix material; the binder matrix material further comprising or consisting of tantalum-containing inclusions, the tantalum-containing inclusions being carbide nanoparticles or intermetallic nanoparticles, the tantalum-containing inclusions having the shape that is any one of substantially spherical, platelet-like or needle-like, the tantalum content being between 1.5 weight per cent and 15 weight per cent of the binder content; and wherein the tantalum-containing inclusions have a mean largest linear dimension of no more than 80 nm.

Optionally, the tantalum content may be between 3.5 weight per cent and 15 weight per cent of the binder content.

Further preferable and/or optional features of the fourth aspect of the invention are provided in the appended claims.

BRIEF DESCRIPTION OF THE DRAWINGS

Non-limiting example arrangements to illustrate the present disclosure are described with reference to the accompanying drawings, in which.

DETAILED DESCRIPTION

Figure 1:
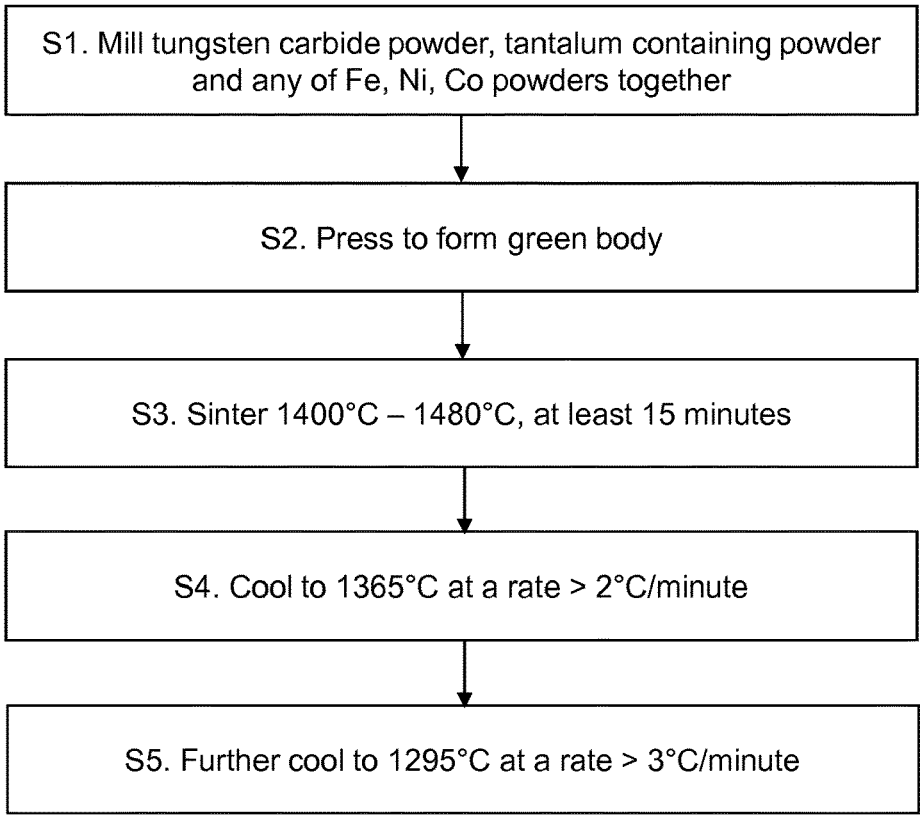
FIG. 1 is a flow diagram showing exemplary steps to make a carbide material.

FIG. 1 is a flow diagram showing exemplary steps, in which the following numbering corresponds to that of FIG. 1.

S1. Precursor powders of metal carbide (such as tungsten carbide), tantalum-containing powders, and matrix precursor powders are milled together to form an intimate mixture and obtain a desired particle size. Matrix precursor powders are typically selected from particles containing any of iron, nickel, cobalt, and combinations thereof.

S2. The milled powders are dry pressed together to form a green body that has adequate strength for handling during processing.

S3. The dry pressed green body is sintered at a temperature of at least 1400° and no more than 1480° C. for a time period of at least 15 minutes (and preferably no more than 360 minutes). If the temperature of sintering is significantly above around 1480° C. then unwanted grain growth may occur.

S4. The sintered body is then cooled from the sintering temperature of at least 1400° C. to a temperature of 1365° C., at a cooling rate of at least 2° C. per minute. 1365° C. is just below the liquidus temperature of the binder at a low carbon content. A slower cooling rate is found to lead to the formation of thermodynamically stable macro-inclusions of TaC-based carbide phases instead of the desired precipitation of Ta-containing nanoparticles.

S5. The sintered body is then cooled from 1365° to a temperature of 1295° C. at a cooling rate of at least 3° C. per minute. At 1295° C., it is slightly below the liquidus temperature of the binder at a high carbon content, so that at this temperature there is no liquid phase left. The cooling rate is sufficiently high to prevent unwanted, excessive growth of the Ta-containing nanoparticles forming as a result of the cooling from the sintering temperatures down to 1365° C.

The sintering and subsequent cooling treatments described above, when applied to a cemented metal carbide that contains tantalum, surprisingly leads to nano-particles (which are considered herein to be particles having a mean largest linear dimension of no more than 80 nm) having a Ta—W—Co—C chemistry that precipitate in the cobalt based binder without requiring any ageing (annealing at elevated temperature for a period of time). Ageing for 1 hour at 800° C. gave no change in the magnetic properties, but longer ageing periods were found to lead to an increased magnetic coercivity. This allows the binder nano-hardness to be significantly increased, and mechanical and performance properties to be considerably improved. The increase in nano-hardness arises from the presence of the hard carbide nano-particles, and is not associated with a reduction in toughness. It has also been surprisingly found that such cemented carbides can be successfully employed in applications characterized by severe mechanical fatigue and can be produced as medium-grain grades suitable for percussive drilling and rotary drilling.

Non-limiting examples of cemented carbide material are described in more detail below.

EXAMPLE 1

Medium-grain tungsten carbide powder with a mean grain size of about 2.5 μm (DS250 from H. C. Starck, Germany) and a carbon content of 6.13 wt. %, was milled together with about 6 wt. % cobalt powder and about 0.2 wt. % TaC powder, which corresponds to the relative Ta content with respect to the Co binder of about 3.33 wt. %, with a mean grain size of about 1 μm. The Co grains had an average grain size of about 1 μm. The milling was performed a ball mill in a milling medium consisting of hexane with 2 wt. % paraffin wax, and using a powder-to-ball ratio of 1:6 for 24 hours.

After drying the graded powder, samples of various sizes including those for examining transverse rupture strength (TRS) according to the ISO 3327-1982 standard and 7-mm parabolic inserts for use as percussive drilling bits were pressed to form green bodies.

The pressed green bodies were sintered at 1440° C. for 75 min, including a 45 minute vacuum sintering stage and a 30 minute high isostatic pressure (HIP) sintering stage carried out in an argon atmosphere at a pressure of 40 bar.

After the sintering at 1440° C., the resultant sintered articles were cooled down to 1365° C. at a cooling rate of 2.2° C. per minute and afterwards from 1365° C. to 1295° C. (the temperature range where liquid Co-based binder solidifies) at a cooling rate of 3.3° C. per minute. The cooling rate was uncontrolled during further cooling from 1295° C. to room temperature.

In addition, powder samples containing large inclusions of paraffin wax were prepared for measuring the binder nano-hardness. After pre-sintering at 300° C. for 1 h, the paraffin wax was removed leaving pores in pre-sintered green bodies. These pores were filled with the liquid Co-based binder during the HIP sintering stage forming Co pools with sizes of about 30 μm suitable for measuring the nano-hardness. Metallurgical cross-sections were then made in order to allow the examination of microstructure, Vickers hardness and nano-hardness.

The binder nano-hardness was measured by use of add-on depth-sensing nano-indentation. The spatially and depth resolved information on the micromechanical properties of the binder was determined using a nano-indentation device. The measurements were carried out at a load of 500 μN using a Bercovich Indenter. Transmission Electron Microscopy (TEM), high resolution TEM (HRTEM) and electron diffraction studies of the binder were carried out on a Technai instrument and a TITAN 60-300 instrument. 32-mm drilling bites with 2 central inserts and 6 gauge inserts were made with the 7-mm inserts for laboratory performance tests on percussive drilling. The laboratory performance tests on percussive drilling were performed using the conditions shown in in Table 1:

TABLE 1

| Percussive drilling test conditions | |
|---|---|
| blow energy | 200 J |
| Torque | 250 Nm |
| blow frequency | 2700 bl./min |
| rotation speed | 75 rev/min |
| axial blow force | 10,000 N |
| pressure of compression air | 50 N/cm$^2$ |
| flow rate of cooling water | 35 l/min |

Figure 2:
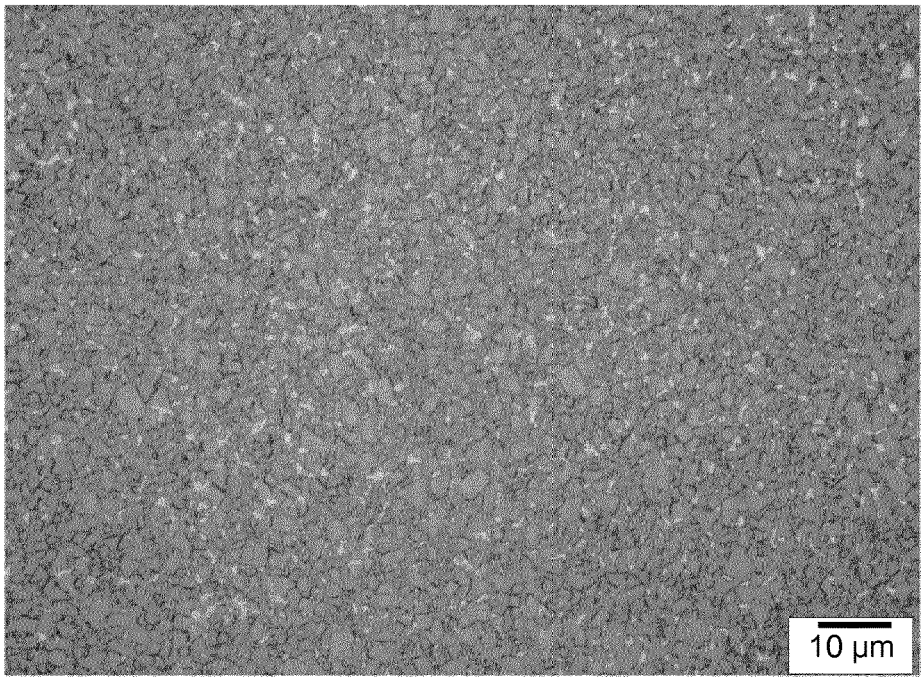
FIG. 2 is a micrograph of a cemented carbide sample made according to Example 1 (light microscopy after etching in the Murakami solution for 5 min)

FIG. 2 shows the microstructure of the cemented tungsten carbide of Example 1. The sample was found to comprise only WC and the binder phase; no eta-phase or free carbon was found. The microstructure indicates that the cemented carbide is medium-grain.

The properties of the cemented carbide are shown in Table 2.

TABLE 2

| Measured properties of cemented carbide of Example 1 | |
|---|---|
| Density | 14.90 g/cm$^3$ |
| TRS | 3900 MPa |
| HV20 | 14.6 GPa |
| coercive force | 166 Oe |
| magnetic moment | 9.2 Gcm$^3$/g (95% of that for the cemented carbide comprising nominally pure Co) |
| binder nano-hardness | 9.0 GPa |

It was found that after drilling 3 m of extremely abrasive rock (quartzite) the average wear of the 7-mm gauge carbide inserts was 0.3 mm.

Figure 3:
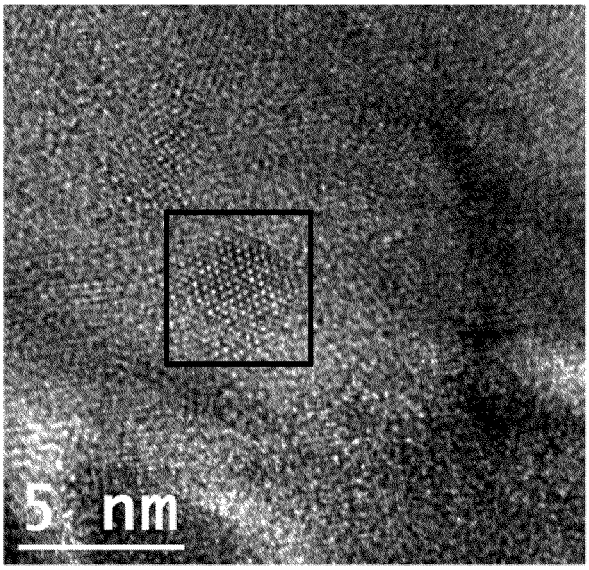
FIG. 3 is a transmission electron micrograph of a first type of nano-particle.
Figure 4A:
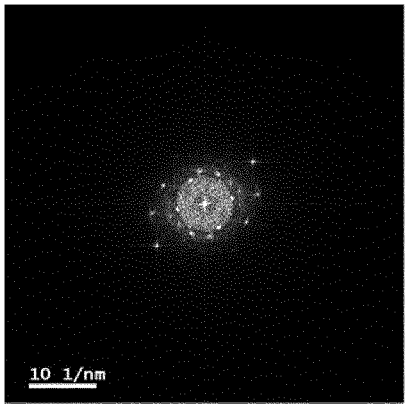
FIGS. 4*a* and 4*b* are electron diffraction patterns from cubic and hexagonal η-phase nano-particles.
Figure 4B:
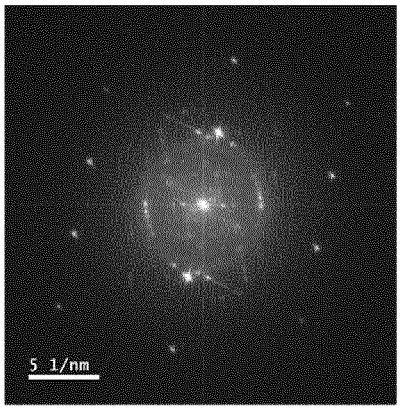

Two types of nano-particle were observed in the binder microstructure. FIG. 3 is a transmission electron micrograph showing a first type of nano-particle (highlighted in a square). These particles varied between 1 and 5 nm in diameter. The first type of nano-particles were found to be of an η-type phase based on either cubic $Co_6(W, Ta)_6C$ or hexagonal $Co_3(W, Ta)_{10}C_3$, as shown in FIGS. 4*a* and 4*b* respectively. The electron diffraction reflections of the η-phases have a low intensity relative to the Co-based matrix and are difficult to discern, and so the presence of the η-type phases was revealed using HRTEM and analysis of Fast Fourier Transform (FFT) patterns.

Figure 5:
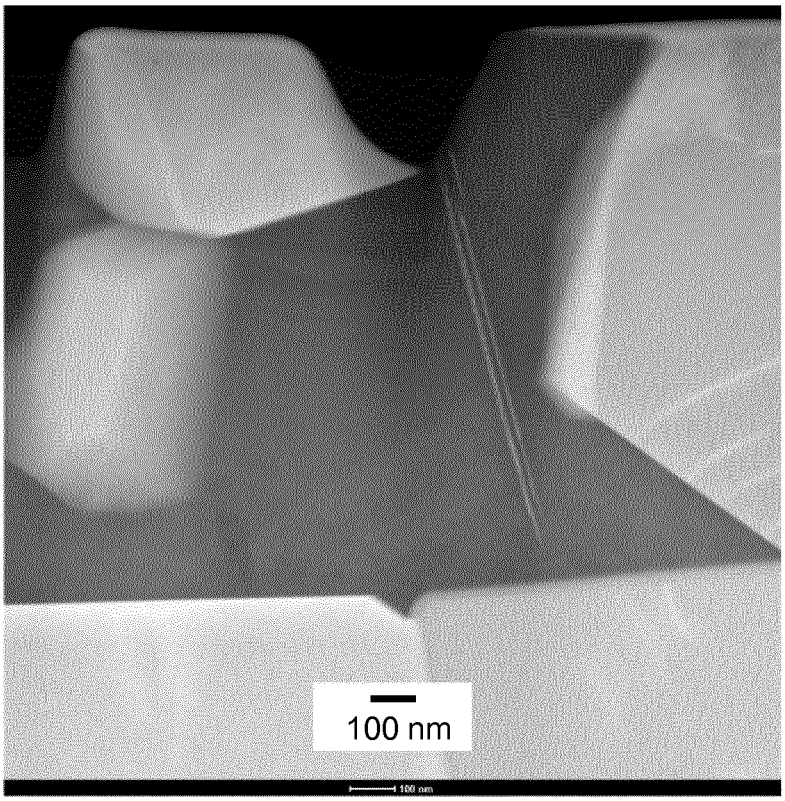
FIG. 5 is a scanning transmission electron microscopy image of a cemented carbide sample made according to Example 1.
Figure 6:
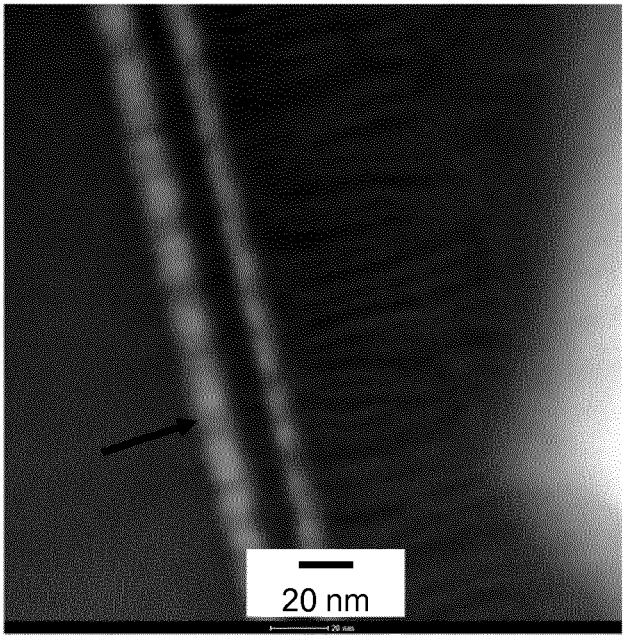
FIG. 6 is a further scanning transmission electron microscopy image of a cemented carbide sample made according to Example 1.
Figure 7:
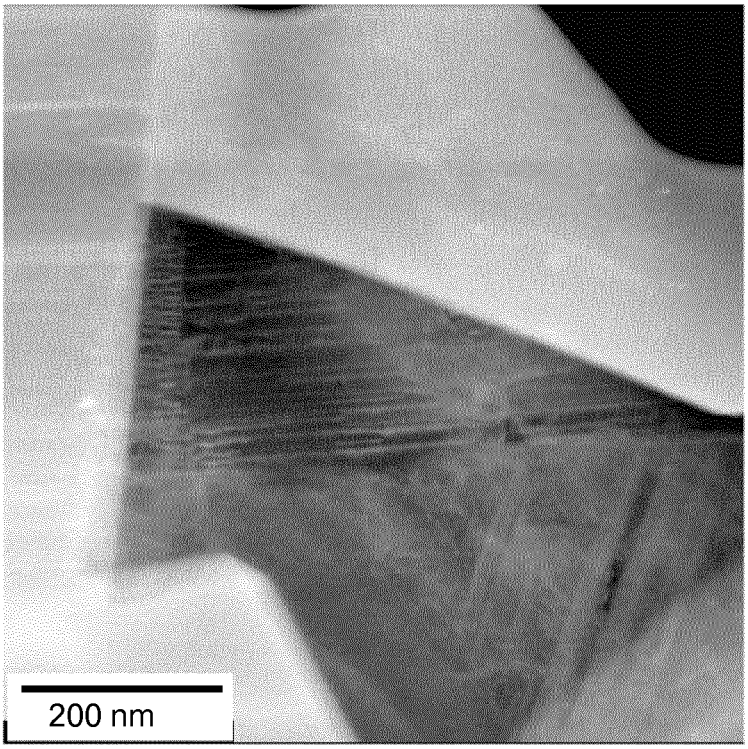
FIG. 7 is a high angle annular dark field (HAADF) image of a cobalt grain showing a secondary precipitated phase in form of lamellae.

A second type of nano-particle is shown in FIGS. 5 and 6. These nanoparticles can form 'chains' comprising connected rounded nanoparticles of nearly 15 nm in size. FIG. 5 is a STEM image of the structure at a relatively low magnification and FIG. 6 is a STEM image at a higher magnification showing the chains of nano-particles in the binder. While this crystalline phase has not yet been fully characterised, the same phase has also been observed forming as thin lamellae or disc-like precipitates, as shown in FIG. 7. FIG. 7 is a high angle annular dark field (HAADF) image of a cobalt grain. The bright lines correspond to a precipitated phase in the form of thin lamellae/discs. The discs have a thickness of around 10 nm and a length of between 40 and 200 nm. These precipitates give diffraction patterns which have observed inter-planar distance of 0.227, 0.222, 0.213, 0.170, 0.129, 0.125, 0.115, 0.107, 0.097, 0.085 and 0.082 nm. The binder may be oversaturated with Ta and, as a result of the selected cooling conditions, the chains of nanoparticles and lamellae/disks mentioned above can precipitate. The crystal lattice of the phase forming the chains of nanoparticles and lamellae/disks corresponds to the $Co_3W$ compound having a cubic crystal lattice in the fcc Co matrix and hexagonal crystal lattice in the hcp Co matrix. According to the results of Auger Electron Spectroscopy (AES) this phase comprises Co, W, Ta and C.

Figure 8:
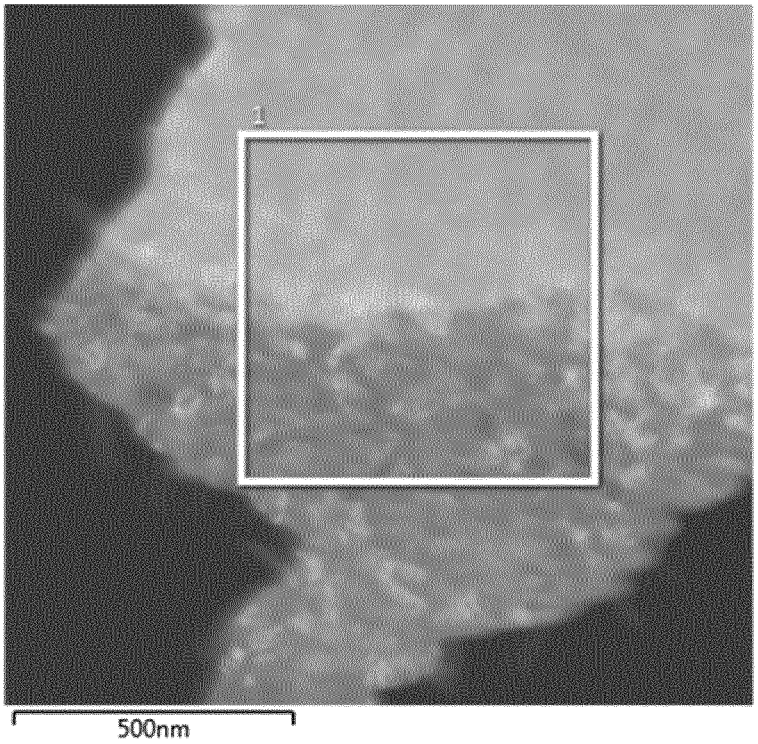
FIG. 8 a scanning transmission electron microscopy image of a cemented carbide sample made according to Example 1, showing an area from which EDX data were obtained.

Energy-dispersive X-ray spectroscopy (EDX) analysis was taken from a microstructure shown in FIG. 8, which shows a large binder pool comprising the nanoparticles. The EDX results are shown in Table 3, and show the presence of tantalum in the binder pool comprising the nanoparticles (note that carbon was not taken into consideration when calculating the elemental composition of the binder pool). The Ta content was higher than expected, possibly owing to selective etching of elements during sample preparation.

TABLE 3

EDX results

| Element | Line type | k-factor | wt. % | Sigma wt. % | At. % |
|---|---|---|---|---|---|
| Co | K | 0.069 | 75.76 | 1.70 | 90.64 |
| Ta | L | 0.133 | 10.42 | 1.43 | 4.06 |
| W | L | 0.135 | 13.82 | 1.36 | 5.30 |
| Sum: | | | 100.00 | | 100.00 |

EXAMPLE 2

Carbide articles and inserts having the same geometry as described in Example 1 were made by use the same method described in Example 1. However, during milling the graded powder about 1.6 wt. % tungsten metal powder (mean grain size of about 1 micron) were added to the powder mixture in order to reduce the total carbon content. The relative content of Ta with respect to the Co binder was kept the same as in Example 1, i.e. about 3.33 wt. %. The samples and inserts as well as drilling bits with the cemented carbide inserts were made and tested using the same conditions as those described in Example 1.

It was found that microstructure of the cemented carbide articles comprised only the WC phase and the Co-based binder. No eta-phase or macro-inclusions of the second Ta-containing carbide phase were found.

The properties of the cemented carbide of Example 2 are shown in Table 4.

TABLE 4

| Measured properties of cemented carbide of Example 2 | |
|---|---|
| Density | 14.93 g/cm$^3$ |
| TRS | 3100 MPa |
| HV20 | 15.0 GPa |
| coercive force | 172 Oe |
| magnetic moment | 7.1 Gcm$^3$/g (73% of that for the cemented carbide comprising nominally pure Co) |
| binder nano-hardness | 10.0 GPa. |

It can be seen that the magnetic moment of the cemented carbide according to Example 2 is lower indicating that the carbon content is also lower. The coercive force and Vickers hardness, as well as the binder nano-hardness, are higher indicating that presumably more hard nano-particles were formed in the binder phase, in comparison with the cemented carbide with the medium carbon content produced according to Example 1.

It was found that after drilling 3 m of the quartzite rock, the average wear of the 7-mm inserts was 0.2 mm, so that the wear-resistance of the cemented carbide according to Example 2 was better than that of the cemented carbide produced according to the Example 1, presumably as a result of the higher Vickers hardness and binder nano-hardness.

Figure 9:
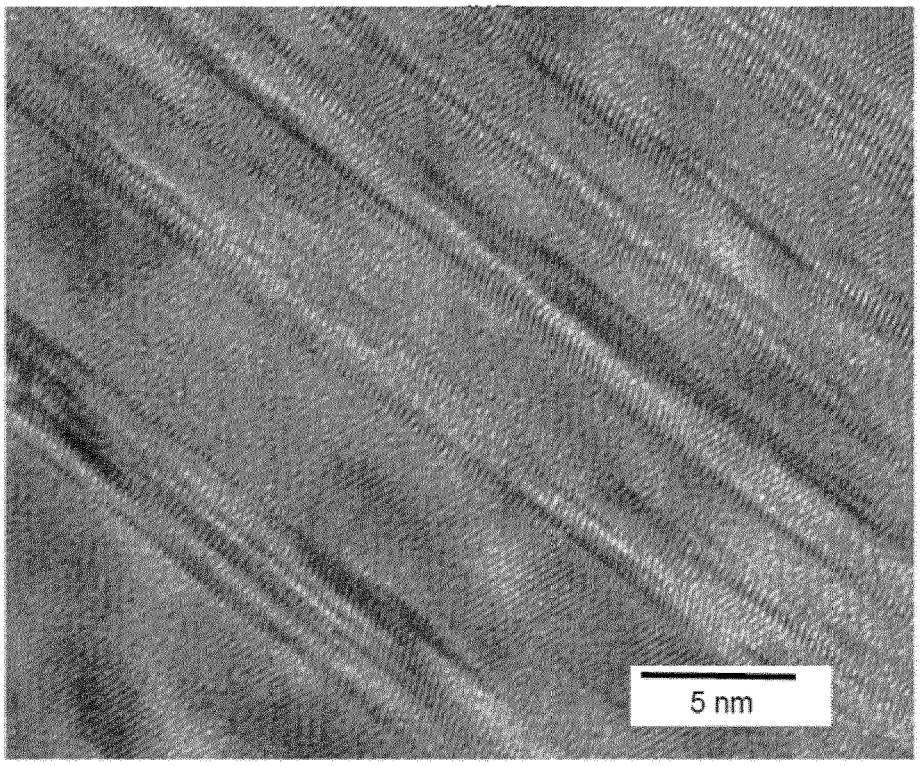
FIG. 9 is an image of a third type of nano-particles observed in the binder nanostructure, which have an elongate lamellae shape.
Figure 10:
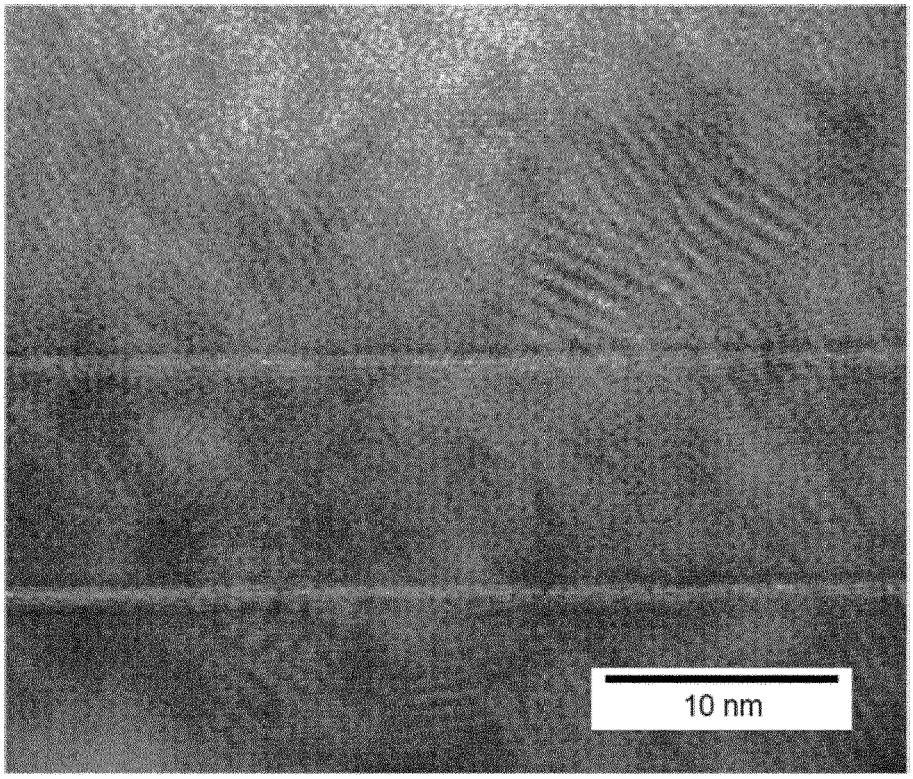
FIG. 10 is an image of a fourth type of nano-particles observed in the binder nanostructure, which have a rounded shape.

Four types of nano-particle were observed in the binder microstructure. The first and second types of the nano-particles were the same as in the binder of the cemented carbide made according to Example 1. The nano-particles of the third type, which are shown in FIG. 9, have a shape of thin and long lamellae of several nanometres in thickness and up to 100 nm in length. The nano-particles of the fourth type, which are shown in FIG. 10, are rounded and about 10 nm in diameter.

EXAMPLE 3

As a control, carbide articles and inserts having the same geometry as described in Example 1 were made by use the same methods described in Example 1. However, no TaC was added to the WC-Co graded powder during milling. The cemented carbide of Example 3 is equivalent to a standard grade of cemented carbide used for percussive drilling inserts. The samples and bits with the carbide inserts were tested using the same conditions as those described for Example 1.

The properties of the cemented carbide of Example 3 are shown in Table 5.

TABLE 5

| Measured properties of cemented carbide of Example 3 | |
|---|---|
| Density | 14.91 g/cm$^3$ |
| TRS | 3000 MPa |
| HV20 | 14.4 GPa |
| coercive force | 141 Oe |
| magnetic moment | 9.1 Gcm$^3$/g (94% of that for the cemented carbide comprising nominally pure Co) |
| binder nano-hardness | 4.0 GPa. |

It was found that after drilling 3 m of the quartzite rock, the average wear of the 7-mm inserts was 0.7 mm.

It can be seen that the densities of the cemented carbides of Examples 1 and 3 are approximately the same. However, the transverse rupture strength and binder nano-hardness of the cemented carbide made according to Example 1 were significantly higher than those of Example 3. Furthermore, the average wear after drilling was much lower for the cemented carbide of Example 1 compared to the cemented carbide of Example 3.

The coercive force of the cemented carbide of Example 1 invention is also noticeably higher than that of the conventional cemented carbide of Example 3 at similar hardness values, which indicates the presence of nanoparticles in the binder of the novel cemented carbide.

Note also that TEM and HRTEM analysis did not reveal the presence of any nanoparticles in the binder phase of Example 3.

EXAMPLE 4

Ultra-coarse-grain tungsten carbide powder with mean grain size of 5 μm and carbon content of 6.12 wt. %, was milled with 6.2 wt.% cobalt powder and 0.2 wt. % TaC powder, which corresponds to the Ta relative content with respect to the Co binder of about 3.23 wt. %, with a mean grain size of about 1 μm. The Co grains had an average grain size of about 1 μm. The milling was performed a ball mill in a milling medium consisting of hexane with 2 wt. % paraffin wax, and using a powder-to-ball ratio of 1:6 for 24 hours.

After drying the graded powder, 10 mm inserts having a length of 4.5 mm for mining picks were pressed and sintered at 1440° C. for 75 min, including a 45 minute vacuum sintering stage and a 30 minute high isostatic pressure (HIP) sintering stage carried out in an argon atmosphere at a pressure of 40 bar.

After the sintering at 1440° C. the carbide articles were cooled down to 1365° C. at a cooling rate of 2.2° C. per minute and afterwards from 1365° C. to 1295° C. (the temperature range where liquid Co-based binder solidifies) at a cooling rate of 3.3° C. per minute. The cooling rate was uncontrolled during further cooling from 1295° C. to room temperature.

Figure 11:
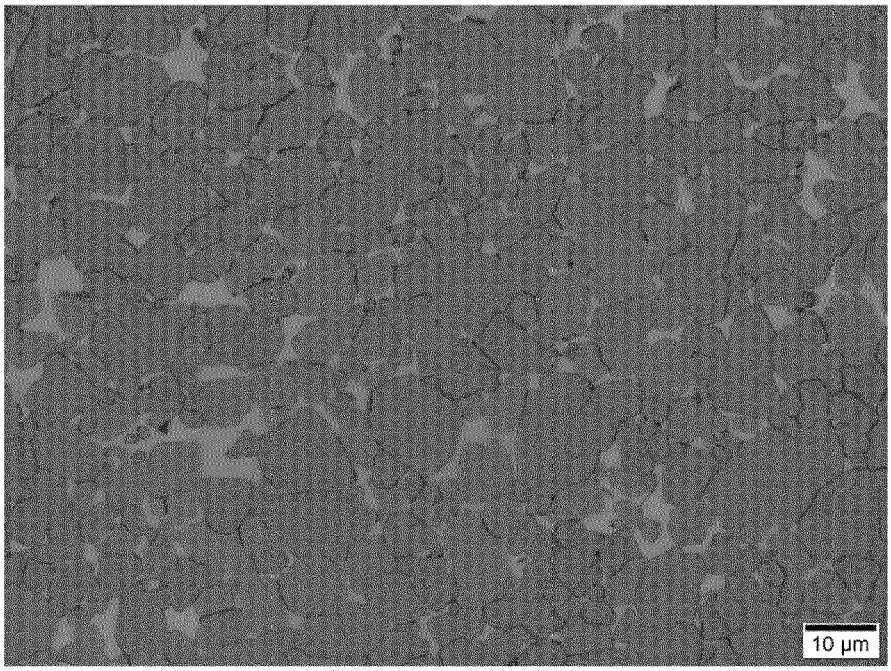
FIG. 11 is an image of a microstructure of Example 3.

The microstructure, which is shown in FIG. 11, was found to comprise only WC and the binder phase; no eta-phase, free carbon or macro-inclusions of the $2^{nd}$ Ta-containing phase was found. The microstructure indicates that the cemented carbide is ultra-coarse-grain.

The properties of the cemented carbide of Example 4 are shown in Table 6.

TABLE 6

| Measured properties of cemented carbide of Example 4 | |
|---|---|
| Density | 14.88 g/cm$^3$ |
| HV20 | 11.4 GPa |
| coercive force | 70 Oe |
| magnetic moment | 9.4 Gcm$^3$/g. (94% of that for the cemented carbide comprising nominally pure Co) |

TEM and HRTEM studies indicated the presence of nano-particles in the binder phase similar to those in the cemented carbide according to Example 1.

Figure 12:
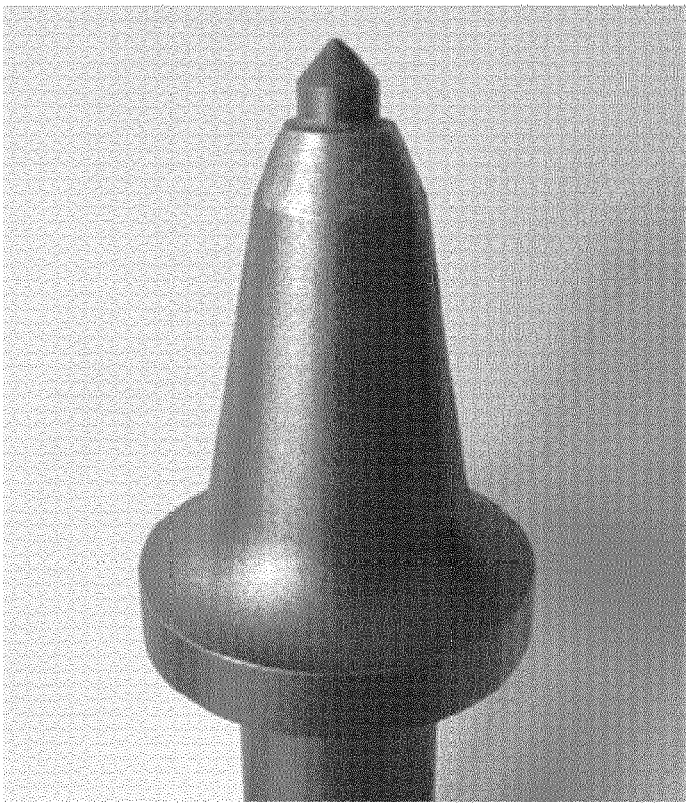
FIG. 12 shows an exemplary pick tool made using the materials of Examples 3 and 4.

Mining picks, as shown in FIG. 12, were produced with the carbide inserts of Example 4 and tested in cutting abrasive concrete. It was found that after cutting 400 m of the abrasive concrete the wear was nearly 0.6 mm. The testing procedure is described in [I. Konyashin, B. Ries Wear damage of cemented carbides with different combinations of WC mean grain size and Co content. Part II: Laboratory performance tests on rock cutting and drilling. Int. Journal of Refractory Metals and Hard Materials 45 (2014) 230-237].

EXAMPLE 5

As a reference, carbide inserts of the same composition, except that they did not contain TaC, were fabricated from the same ultra-coarse-grain tungsten carbide powder as that used in Example 4. The microstructure of the inserts did not contain eta-phase or free carbon.

The properties of the cemented carbide of Example 5 are shown in Table 7.

TABLE 7

| Measured properties of cemented carbide of Example 5 | |
|---|---|
| Density | 14.80 g/cm$^3$ |
| HV20 | 11.0 GPa |
| coercive force | 58 Oe |
| magnetic moment | 9.1 Gcm$^3$/g (91% of that for the cemented carbide comprising nominally pure Co) |

TEM and HRTEM studies did not reveal any nanoparticles in the binder phase.

Mining picks, with the same geometry as that according to Example 4, were produced with the carbide inserts of Example 5 and tested in cutting abrasive concrete. It was found that after cutting 400 m of the abrasive concrete, the wear was nearly 1.4 mm.

The wear-resistance of the cemented carbide containing Ta in form of nanoparticles in the binder phase according to Example 4 is greater than that of Example 5 that does not include Ta-containing nanoparticles in the binder phase by a factor of more than two.

EXAMPLE 6

Carbide articles and inserts having the same geometry as described in Example 1 were made by use the same method described in Example 1. However, during milling the cemented carbide graded powder of 0.11 wt. % TaC, instead of 0.2 wt. % TaC, was added to the powder mixture. The relative Ta content with respect to the Co binder was about 1.83 wt. %. The samples, inserts and bits with the carbide inserts were made and tested using the same conditions as those described for Example 1.

It was found that microstructure of the cemented carbide articles comprised only the WC phase and the Co-based binder. No eta-phase or macro-inclusions of the second Ta-containing carbide phase were found.

The properties of the cemented carbide of Example 6 are shown in Table 8.

TABLE 8

| Measured properties of cemented carbide of Example 6 | |
|---|---|
| Density | 14.90 g/cm$^3$ |
| TRS | 3450 MPa |
| HV20 | 14.6 GPa |
| coercive force | 160 Oe |
| magnetic moment | 9.1 Gcm$^3$/g (94% of that for the cemented carbide comprising nominally pure Co) |
| binder nano-hardness | 7.0 GPa. |

The coercive force, Vickers hardness and binder nano-hardness are lower than those described in Example 1, but still higher than those in Example 3.

HRTEM studies indicated that nano-particles similar to those described in Example 1 are present in the binder phase.

It was found that after drilling 3 m of the quartzite rock, the average wear of the 7-mm inserts was 0.4 mm, so that the wear-resistance of the cemented carbide according to Example 6 was better than that of the standard cemented carbide grade according to the Example 3.

EXAMPLE 7

Carbide articles and inserts having the same geometry as described in Example 1 were made by use the same method described in Example 1. However, during milling the cemented carbide graded powder of 0.07 wt. % TaC, instead of 0.2 wt. % TaC, was added to the powder mixture. The relative Ta content with respect to the Co binder was about 1.16 wt. %. The samples and bits with the carbide inserts were tested using the same conditions as those described for Example 1.

It was found that microstructure of the cemented carbide articles comprised only the WC phase and the Co-based binder. No eta-phase or macro-inclusions of the second carbide phase were found.

The properties of the cemented carbide of Example 7 are shown in Table 9.

TABLE 9

| Measured properties of cemented carbide of Example 7 | |
|---|---|
| Density | 14.95 g/cm$^3$ |
| TRS | 2900 MPa |
| HV20 | 14.4 GPa |
| coercive force | 143 Oe |
| magnetic moment | 9.1 Gcm$^3$/g (94% of that for the cemented carbide comprising nominally pure Co) |
| binder nano-hardness | 4.5 GPa. |

The coercive force, Vickers hardness and binder nano-hardness are close than those in Example 3.

HRTEM studies indicated that no nano-particles similar to those described in Example 1 are present in the binder phase.

It was found that after drilling 3 m of the quartzite rock, the average wear of the 7-mm inserts was 0.7 mm, so that the wear-resistance of the cemented carbide according to Example 7 was the same as that of the cemented carbide according to the Example 3.

EXAMPLE 8

Carbide articles and inserts having the same geometry as described in Example 1 were made by use the same method described in Example 1. However, during milling the cemented carbide graded powder of 2 wt. % TaC, instead of 0.2 wt. % TaC, was added to the powder mixture, so that the relative Ta content with respect to the Co binder was about 33.3 wt. %. The samples and bits with the carbide inserts were tested using the same conditions as those described for Example 1.

Figure 13:
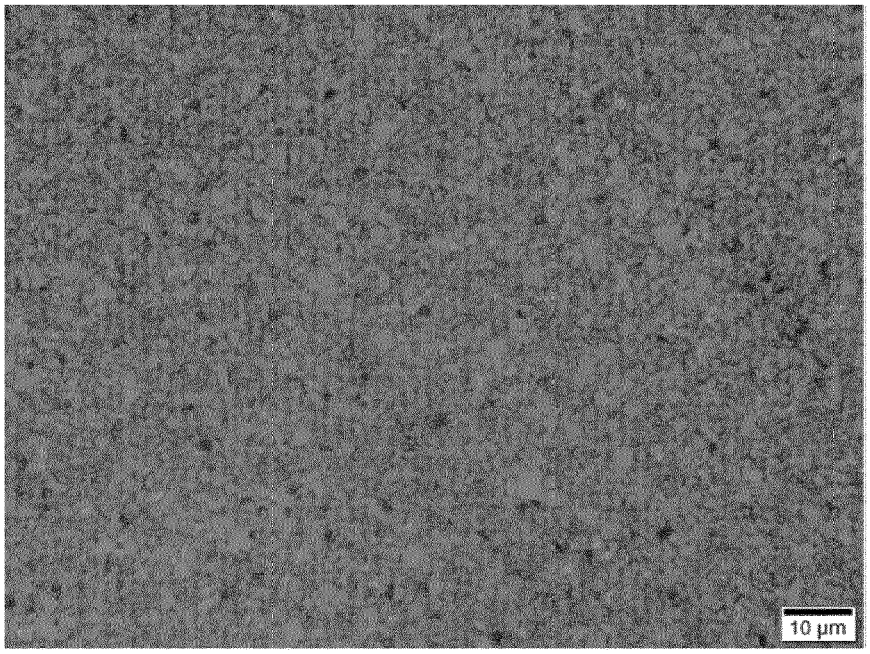
FIG. 13 is an image of a microstructure of Example 8.

It was found that microstructure of the cemented carbide articles comprised additionally to the WC phase and the Co-based binder macro-grains of the 2$^{nd}$ carbide phase on the basis of (Ta,W)C having a shape of relatively large rounded inclusions, which are shown in FIG. 13. These macro-inclusions of the 2nd carbide phase can be seen in FIG. 13 as dark particles after etching in the Murakami reagent for 5 min.

The properties of the cemented carbide of Example 8 are shown in Table 10.

TABLE 10

| Measured properties of cemented carbide of Example 8 | |
|---|---|
| Density | 14.93 g/cm$^3$ |
| TRS | 2040 MPa |
| HV20 | 15.0 GPa |
| coercive force | 184 Oe |
| magnetic moment | 8.0 Gcm$^3$/g (83% of that for the cemented carbide comprising nominally pure Co) |
| binder nano-hardness | |

The coercive force, Vickers hardness and binder nano-hardness are close than those in Example 1, however, the TRS value is significantly lower.

It was found that after drilling 30 cm of the quartzite rock, all the gauge 7-mm inserts of the drilling bit were broken indicating that the performance toughness of the cemented carbide according to Example 8 was dramatically reduced.

EXAMPLE 9

Carbide articles and inserts having the same geometry as described in Example 1 were made by use the same method described in Example 1. However, during milling the cemented carbide graded powder of 0.6 wt. % TaC, instead of 0.2 wt. % TaC, was added to the powder mixture, so that the relative Ta content with respect to the Co binder was about 10 wt. %. The samples and bits with the carbide inserts were tested using the same conditions as those described for Example 1.

Figure 15:
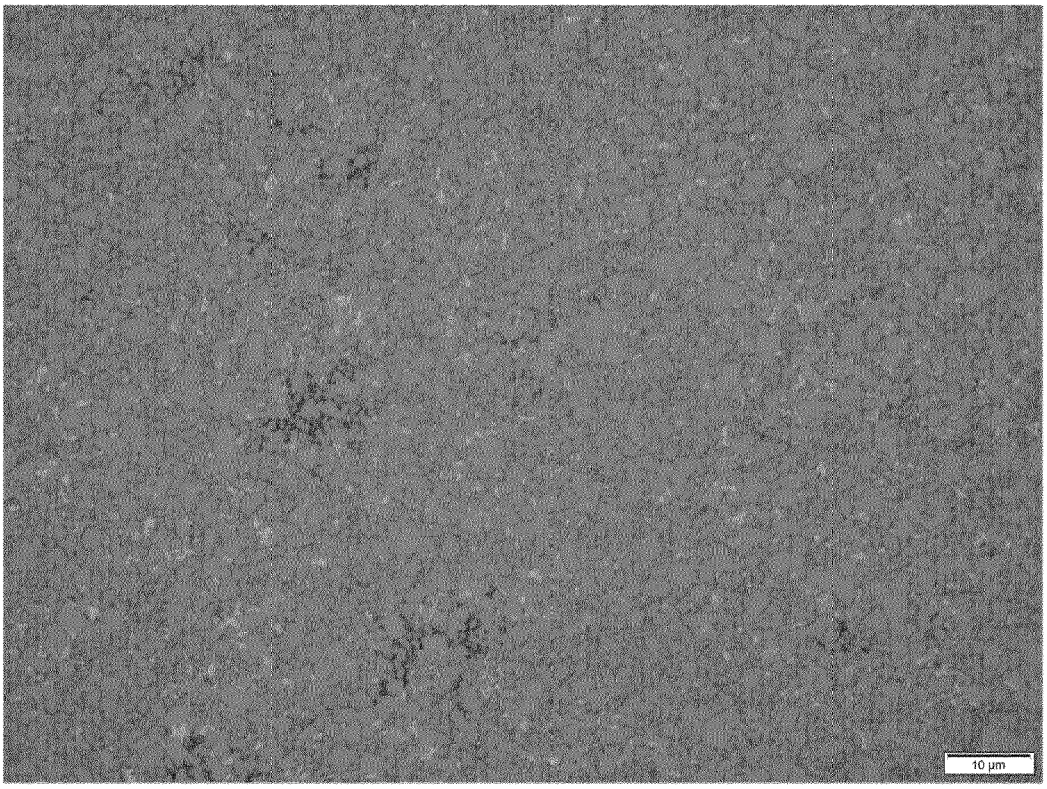
FIG. 15 is an image of a microstructure of the cemented carbide sample according to Example 9.

It was found that microstructure of the cemented carbide articles comprised additionally to the WC phase and the Co-based binder an insignificant number of macro-grains of the 2$^{nd}$ carbide phase on the basis of (Ta,W)C, which are shown in FIG. 15. These macro-grains of the 2nd carbide phase can be seen in FIG. 15 as "lace"-like dark inclusions surrounding the WC grains after etching in the Murakami reagent for 5 min. The properties of the cemented carbide of Example 9 are shown in Table 11, indicating that the presence of the 2nd carbide phase as "lace"-like dark inclusions surrounding the WC grains does not lead to a detrimental decrease of mechanical and performance properties of the cemented carbide according to Example 9.

Nevertheless, the properties are not better than that of the cemented carbide according to Example 1 containing significantly less TaC. When taking into account the very high prices of tantalum and consequently tantalum carbide it appears to be reasonable to produce the cemented carbides inserts with the lower amount of added TaC corresponding to Example 1.

TABLE 11

| Measured properties of cemented carbide of Example 9 | |
|---|---|
| Density | 14.89 g/cm$^3$ |
| TRS | 3820 MPa |
| HV20 | 14.7 GPa |
| coercive force | 167 Oe |
| magnetic moment | 9.1 Gcm$^3$/g (94% of that for the cemented carbide comprising nominally pure Co) |
| binder nano-hardness | |

It was found that after drilling 30 cm of the quartzite rock, all the 7-mm inserts of the drilling bit were not broken indicating that the performance toughness of the cemented carbide according to Example 9 was not reduced. It was found that after drilling 3 m of quartzite the average wear of the 7-mm gauge carbide inserts was 0.3 mm.

EXAMPLE 10

Carbide articles and inserts having the same geometry as described in Example 1 were made by use the same method described in Example 1. However, during milling the cemented carbide graded powder of 0.9 wt. % TaC, instead of 0.2 wt. % TaC, was added to the powder mixture, so that the relative Ta content with respect to the Co binder was about 15 wt. %. The samples and bits with the carbide inserts were tested using the same conditions as those described for Example 1.

It was found that microstructure of the cemented carbide articles comprised additionally to the WC phase and the Co-based binder an insignificant number of macro-grains of the 2$^{nd}$ carbide phase on the basis of (Ta,W)C, which morphology of which was similar to that shown in FIG. 15. The properties of the cemented carbide of Example 10 are shown in Table 12, indicating that the presence of the 2nd carbide phase as "lace"-like dark inclusions surrounding the WC grains does not lead to a noticeable decrease of mechanical and performance properties of the cemented carbide according to Example 10. Nevertheless, the properties are not better than that of the cemented carbide according to Example 1 containing significantly less TaC. When taking into account the very high prices of tantalum and consequently tantalum carbide it appears to be reasonable to produce the cemented carbides inserts with the lower amount of added TaC corresponding to Example 1, although the higher amounts of TaC added to the cemented carbide material are also acceptable.

TABLE 12

| Measured properties of cemented carbide of Example 10 | |
|---|---|
| Density | 14.89 g/cm$^3$ |
| TRS | 3740 MPa |
| HV20 | 14.7 GPa |
| coercive force | 169 Oe |
| magnetic moment | 9.1 Gcm$^3$/g (94% of that for the cemented carbide comprising nominally pure Co) |
| binder nano-hardness | |

It was found that after drilling 30 cm of the quartzite rock, all the 7-mm inserts of the drilling bit were not broken indicating that the performance toughness of the cemented carbide according to Example 10 was not reduced. It was found that after drilling 3 m of quartzite the average wear of the 7-mm gauge carbide inserts was 0.3 mm.

EXAMPLE 11

Figure 14:
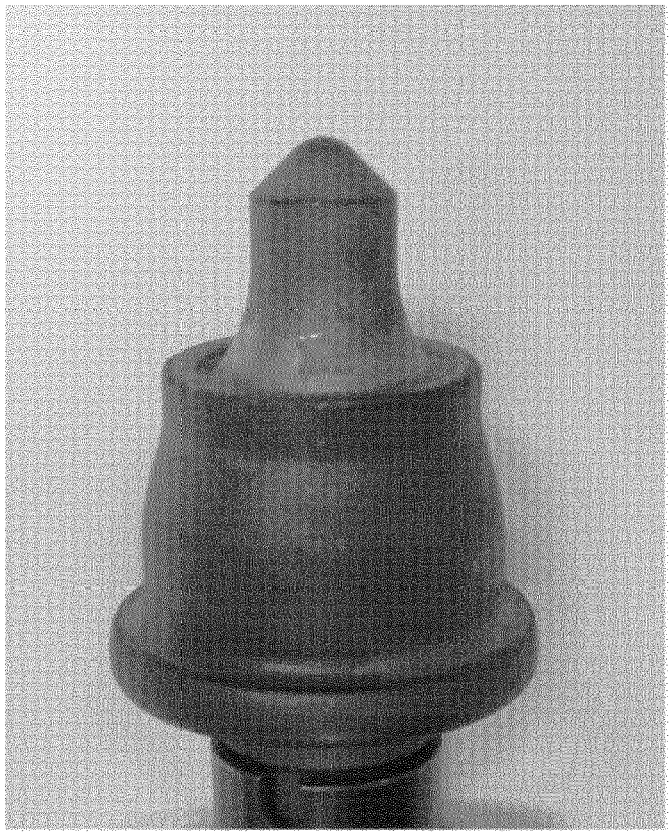
FIG. 14 shows an exemplary pick tool made using the materials of Example 4 and 5.
Figure 16:
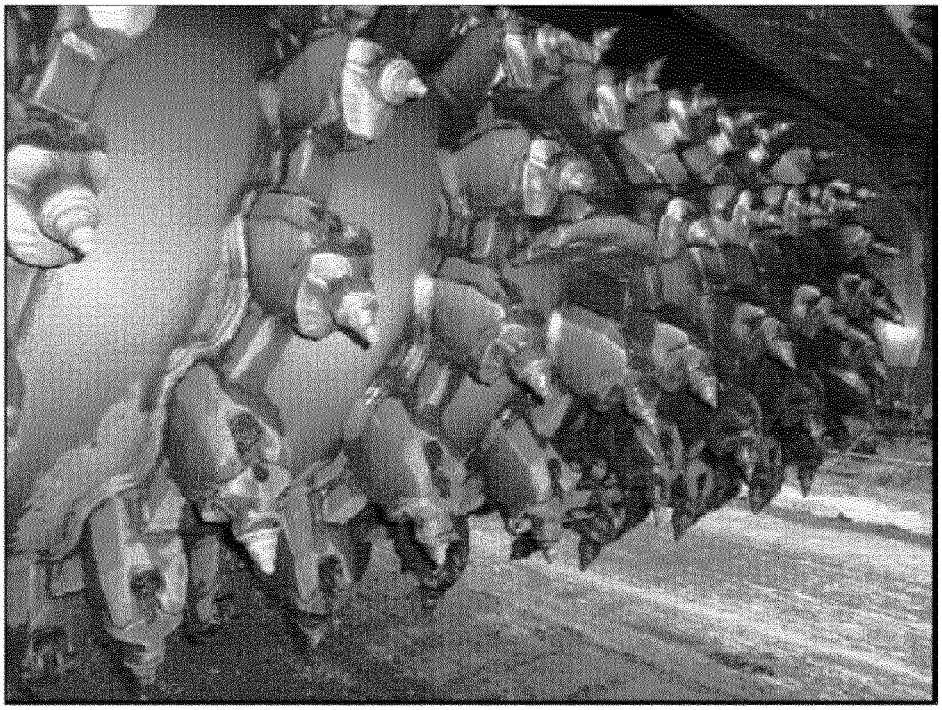
FIG. 16 is an image of road planning equipment featuring a drum and a plurality of road planning picks.

Road-planing picks, one of which is shown in FIG. 14, were produced with tips from the cemented carbides according to Example 4 and Example 5 and field-tested in road-planing by milling abrasive asphalt. The picks were preliminary marked and mixed up followed by their inserting into a drum for road-planing shown in FIG. 16.

The test conditions were as follows: milling depth—20 cm, milled distance—2800 m, milling feed—10-14 m/min, water cooling—100%, volume of milled asphalt—2345 m$^3$.

After the field-test the picks were removed from the drum, sorted out and both the number of breakages and mean wear value were measured.

Figure 17:
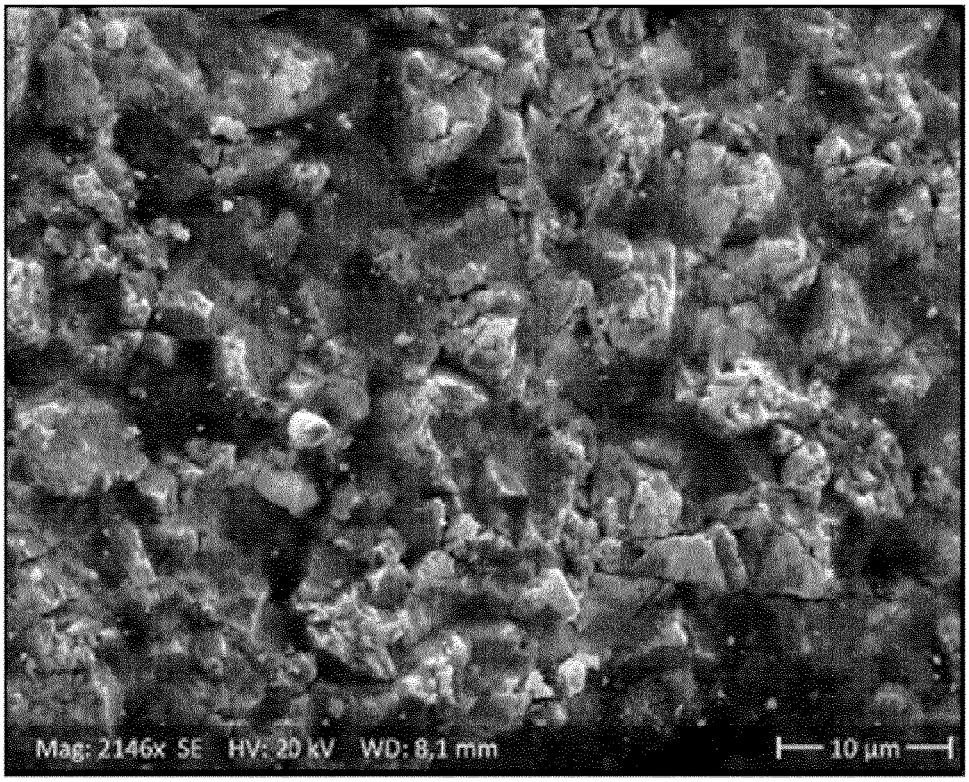
FIG. 17 is an image of a wear surface of a carbide tip made according to Example 4 after the field test.
Figure 18:
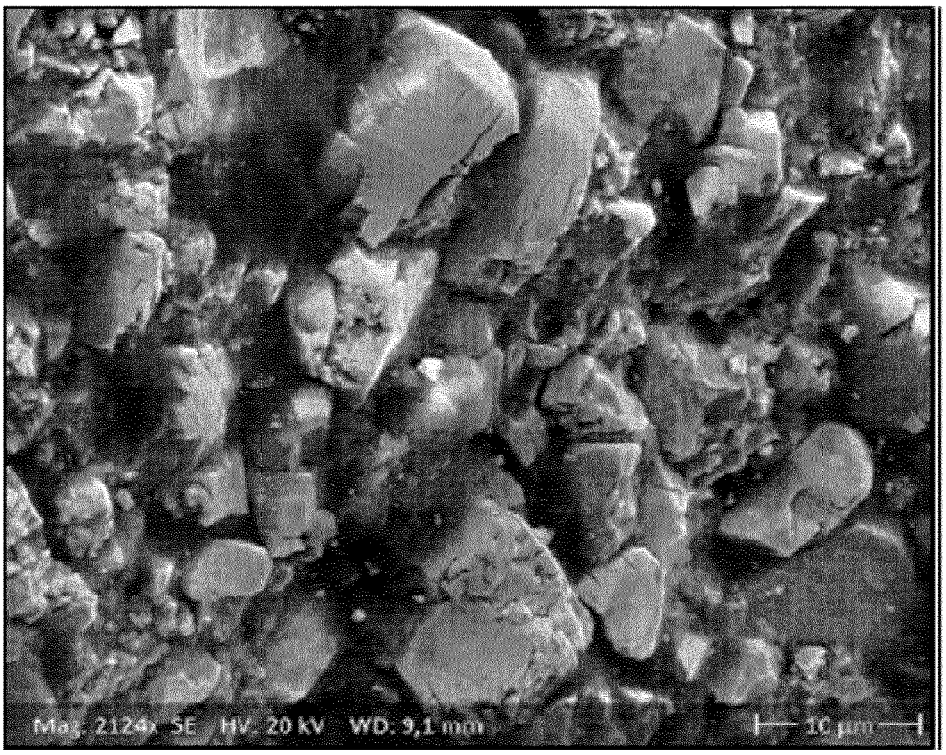
FIG. 18 is an image of a wear surface of a carbide tip made according to Example 5 after the field test.

It was established that 4.8% picks with the tips produced according to Example 4 were broken and the mean wear value was about 4.0 mm, whereas the number of broken picks with the tips produced according Example 5 (standard cemented carbide grade) was equal to 9.2% and the mean wear value was 7.8 mm. Therefore, the cemented carbide made according to Example 4 is characterised by both improved performance toughness and significantly better wear-resistance resulting in its prolonged tool life. This is achieved as a result of the significantly improved wear-resistance of the binder, which can be seen in FIG. 17 and FIG. 18 showing wear surfaces of the carbides tips of the both cemented carbide grades after the field test. It is clearly seen in FIG. 17 that the binder phase in the cemented carbide made according to Example 4 is only slightly worn out leaving the WC grains supported and thus preventing their intensive micro-cracking and detachment from the cemented carbide surface. In contrast to that, as one can see in FIG. 18, the binder phase in the standard cemented carbide grade made according to Example 5 is very intensively worn out leaving the WC grains unsupported. As a result, the WC grains can be easily chipped, broken and detached from the cemented carbide surface, thus resulting in a significantly greater wear rate of the cemented carbide as a whole.

It is known to manufacture cemented carbide bodies that have a compositional gradient from the surface to the core. This can be done by, for example, careful control of heat treatments. In particular, the time, temperature and atmosphere can be used to manufacture such a body as described in, for example, WO 2010/097784 (the contents of which are incorporated herein). The techniques described therein can be used to manufacture a cemented carbide body with a surface region contiguous with a core region where the mean binder fraction of the core region is greater than that of the surface region. This gives the surface region enhanced wear resistance and toughness. The surface region is a layer integrally formed with the core region (in most applications, a thickness of between 0.5 mm and 10 mm is usually sufficient). The mean binder fraction within the surface region is typically lower than that within the core region by a factor of at least 0.05 and at most 0.90.

The cemented carbide as described herein may be used as part of a tool, such as a road or mining pick.

Various example embodiments of cemented carbides, methods for producing cemented carbides, and tools comprising cemented carbides have been described above. Those skilled in the art will understand that changes and modifications may be made to those examples without departing from the scope of the appended claims.

The invention claimed is:

1. A cemented carbide body comprising:

a. tungsten carbide grains;

b. a binder matrix material comprising any of cobalt, nickel and iron or a mixture thereof, wherein the tungsten carbide grains are disposed in the binder matrix material;

the binder matrix material also comprising tantalum-containing inclusions, the tantalum-containing inclusions being carbide nanoparticles or intermetallic nanoparticles, the tantalum-containing inclusions having the shape that is any one of spherical, platelet-like or needle-like;

c. the tantalum-containing inclusions being present in the binder matrix material so that the binder matrix material contains tantalum in a quantity of between 1.5 weight percent and 3.5 weight percent, wherein the cemented carbide body is free of Ta-containing grains having a largest linear dimension greater than 500 nm; and d. wherein the tantalum-containing inclusions have a mean largest linear dimension of no more than 80 nm measured using Transmission Electron Microscopy (TEM) or High Resolution Transmission Electron Microscopy (HRTEM).

2. The cemented carbide body according to claim 1, wherein the tantalum-containing inclusions have a mean largest linear dimension of no more than 50 nm.

3. The cemented carbide body according to claim 1, in which the inclusions comprise a material according to the formula $Ta_xW_yCo_zC$ phase, where x is a value in the range from 1 to 8, y is a value in the range from 0 to 8 and z is a value in the range from 0 to 10.

4. The cemented carbide body according to claim 1, wherein the inclusions comprise any of a cubic η-phase comprising $Co_6(W,Ta)_6C$ and a hexagonal η-phase comprising $Co_3(W,Ta)_{10}C_3$.

5. The cemented carbide body according to claim 1, wherein the carbide nanoparticles or intermetallic nanoparticles form chains comprising connected rounded nanoparticles.

6. The cemented carbide body according to claim 1, further comprising lamellae shaped tantalum-containing nanoparticles with a mean largest linear dimension of no more than 80 nm.

7. The cemented carbide body according to claim 1, in which the nano-hardness of the binder matrix material is at least 6 GPa determined using a nano-indentation device at a load of 500 μN together with Transmission Electron Microscopy (TEM) or High Resolution Transmission Electron Microscopy (HRTEM).

8. The cemented carbide body according to claim 1, wherein the body is employed for high-pressure high-temperature components for diamond or cBN synthesis.

9. The cemented carbide body according to claim 1, wherein the tantalum-containing inclusions have a mean largest linear dimension of below 20 nm.

10. The cemented carbide body according to claim 1, wherein the tantalum-containing inclusions have a mean largest linear dimension of below 10 nm.

11. The cemented carbide body according to claim 1, in which the nano-hardness of the binder matrix material is at least 8 GPa determined using a nano-indentation device at a load of 500 μN together with Transmission Electron Microscopy (TEM) or High Resolution Transmission Electron Microscopy (HRTEM).

12. The cemented carbide body according to claim 1, in which the nano-hardness of the binder matrix material is at least 10 GPa determined using a nano-indentation device at a load of 500 μN together with Transmission Electron Microscopy (TEM) or High Resolution Transmission Electron Microscopy (HRTEM).

13. A cemented carbide body as claimed in claim 1, wherein the body is employed as a substrate for polycrystalline diamond (PCD).

14. A tool comprising the cemented carbide body according to claim 1.

15. The tool according to claim 14, which is a pick for road-planing or a pick for mining or which is a drill bit for rotary or percussive drilling.

16. A method of making the cemented carbide body according to claim 1, the method comprising:

a. milling together powders of tungsten carbide, a tantalum containing material, and powders containing any of cobalt, nickel and iron or a mixture thereof;

b. pressing the milled powder to form a green body;

c. sintering the green body in a vacuum at a temperature between 1400° C. and 1480° C. for a time of at least 15 minutes;

d. cooling the sintered body down from the sintering temperature to a temperature of 1365° C. at a cooling rate of at least 2° C. per minute;

e. further cooling the sintered body from 1365° C. to 1295° C. at a cooling rate of at least 3° C. per minute to make said cemented carbide body.

17. The method according to claim 16, in which a binder mean free path in the sintered body is in the range of 0.1 μm to 1 μm after cooling down to room temperature.

18. The method according to claim 16, wherein the tantalum containing material is selected from any of tantalum, tantalum carbide, and tantalum containing compounds.

19. The method according to claim 16, comprising sintering the green body in a vacuum at a temperature between 1400° C. and 1480° C. for a duration of no more than 360 minutes.

* * * * *